United States Patent [19]

Taniguchi

[11] Patent Number: 5,060,607

[45] Date of Patent: Oct. 29, 1991

[54] TAPPET STRUCTURE

[75] Inventor: Masato Taniguchi, Nagoya, Japan

[73] Assignee: NGK Spark Plug Co., Ltd., Nagoya, Japan

[21] Appl. No.: 530,694

[22] Filed: May 30, 1990

[30] Foreign Application Priority Data

Jun. 21, 1989 [JP] Japan ..... 1-71654

[51] Int. Cl.[5] ..... F01L 1/14

[52] U.S. Cl. ..... 123/90.51; 74/569; 123/90.48

[58] Field of Search ..... 123/90.48, 90.51; 74/569

[56] References Cited

U.S. PATENT DOCUMENTS

| | | | |
|---|---|---|---|
| 2,055,341 | 9/1936 | Dyer | 123/90.51 |
| 4,317,433 | 3/1982 | Fuhrmann | 123/90.51 |
| 4,366,785 | 1/1983 | Goloff et al. | 123/90.51 |
| 4,508,067 | 4/1985 | Fuhrmann | 123/90.51 |
| 4,598,675 | 7/1986 | Long | 123/90.51 |
| 4,768,476 | 9/1988 | Behnke et al. | 123/90.51 |
| 4,850,095 | 7/1989 | Akao et al. | 123/90.51 |
| 4,902,358 | 2/1990 | Napier et al. | 148/127 |
| 4,909,198 | 3/1990 | Shiraya et al. | 123/90.48 |

FOREIGN PATENT DOCUMENTS

| | | | |
|---|---|---|---|
| 3239325 | 4/1984 | Fed. Rep. of Germany | 123/90.51 |

*Primary Examiner*—E. Rollins Cross
*Assistant Examiner*—Weilun Lo
*Attorney, Agent, or Firm*—Sughrue, Mion, Zinn, Macpeak & Seas

[57] ABSTRACT

In a tappet structure in which a rotary movement is transformed into an axial movement by way of a cam, the tappet structure has a metallic tappet body, an inside of which has a hollow portion in a manner to have an opening at one end of the tappet body. A friction-resistant ceramic plate is integrally fixed to the open end of the tappet body by means of brazing, so that the cam can frictionally slide on the ceramic plate to move the tappet body axially.

2 Claims, 4 Drawing Sheets

Fig. 4

| | cylinder No. | | wear of tappet (μm) | wear of cam (μm) | surface of tappet | surface of cam |
|---|---|---|---|---|---|---|
| prior counterparts | 1 | In | 25 | 45 | * | * |
| | | Ex | 30 | 53 | ditto | ditto |
| | 2 | In | 27 | 60 | ditto | ditto |
| | | Ex | 35 | 45 | ditto | ditto |
| | 3 | In | 30 | 50 | ditto | ditto |
| | | Ex | 26 | 55 | ditto | ditto |
| second embodiment | 4 | In | 4 | 2 | mirror finish | mirror finish |
| | | Ex | 2 | 3 | ditto | ditto |
| | 5 | In | 2 | 3 | ditto | ditto |
| | | Ex | 3 | 1 | ditto | ditto |
| | 6 | In | 2 | 2 | ditto | ditto |
| | | Ex | 1 | 4 | ditto | ditto |

(1) In shows intake side, while Ex exhaust side.

(2) * denotes appearance of severe scuffs.

TAPPET STRUCTURE

BACKGROUND OF THE INVENTION

1. Field of the Invention

This invention relates to a tappet structure improved to have a friction-resistant property, and particularly concerns to a tappet structure well-suited to an internal combustion engine of OHV (Over Head Valve) type.

2. Description of Prior Art

In order to cope with high rpm and high output of an engine, OHC (Over Head Camshaft) type of an internal combustion engine has been increasingly introduced in which a rotary movement of a cam directly allows to move a rocker arm so as to operate a valve.

However, OHV type of an internal combustion engine has been employed in a field of industrial engines and large-scale diesel engines.

In the OHV type of an internal combustion engine, a cam allows to axially move a tappet body which causes to move a rocker arm by way of a push rod, thus causes to operate a valve so as to alternately open and close an intake and exhaust port each communicated with a combustion chamber.

In this case, wear appeared between the tappet body and the cam can't be ignored when taking a demand of high output of the engine into consideration.

On the other hand, light-weight valve system is required to reduce friction loss. In accompany with the request, it is necessary to make the tappet body light-weight. For this reason, it has suggested that whole of the tappet body itself would be integrally made of ceramic material. This tappet, however, makes the material expensive, and rendering it difficult to machine, thus making it practically impossible to apply to a general internal combustion engine.

Therefore, it is an object of the invention to eliminate the above drawbacks, and providing a tappet structure which is capable of achieving friction-resistant property and light-weightness with minimum cost.

SUMMARY OF THE INVENTION

According to the present invention, there is provided a tappet structure comprising; a metallic tappet body, an inside of which has a hollow portion in a manner to have an opening at one end of the tappet body; a friction-resistant ceramic plate integrally fixed to the open end of the tappet body by means of brazing, so that the cam can frictionally slide on the ceramic plate to move the tappet body axially.

The hollowed tappet body makes it possible to contribute to cost-saving and light-weightness, thus coping with high output of the engine. The ceramic plate leads to saving an amount of expensive ceramic material in opposition to the case in which whole of the tappet body is made of ceramic material.

Further, the ceramic plate is fixed to the open end of the hollowed tappet body so that required amount of brazing becomes small.

Friction-resistant material for the ceramic plate can be selected among $Si_3N_4$, $ZrO_2$, $Cr_2O_3$, WC, sialon and cermit.

Among them, $Si_3N_4$ is well-suited to the ceramic plate in view of mechanical strength, manufacturing stability and frictional characteristics.

Additionally, the metallic plate is provided to reinforce the ceramic plate. The reason why the metallic plate has Young's modulus of more than $2\times10^4$ Kg/mm$^2$, is that lower limit of Young's modulus of the ceramic plate is around $2\times10^4$ Kg/mm$^2$.

Therefore, it is feared that the metallic plate with Young's modulus of less than $2\times10^4$ Kg/mm$^2$ may lead to crack of the ceramic plate, even though the metallic plate falls within an elastic limit.

When the JIS SNCM 630 is selected as a metallic material of the plate, the metallic material is sufficient enough to reinforce the ceramic plate. Because the metallic material can be quenched at around 800 degrees Celisius by means of air cooling when the metallic plate is brazed to the tappet body. In this instance, the metallic plate can have Rockwell hardness of HRC 40, and at the same time, having Young's modulus of more than $2\times10^4$ Kg/mm$^2$.

The tappet body preferably is made of a material which may be readily quenched by means of air cooling.

Various other objects and advantages to be obtained by the present invention will be appeared in the following description and in the accompanying drawings.

BRIEF DESCRIPTION OF THE DRAWINGS

FIG. 4 is a table comparing an amount of wear between the tappet body of the present invention and prior counterparts.

DETAILED DESCRIPTION OF PREFERRED EMBODIMENT

Figure 1:
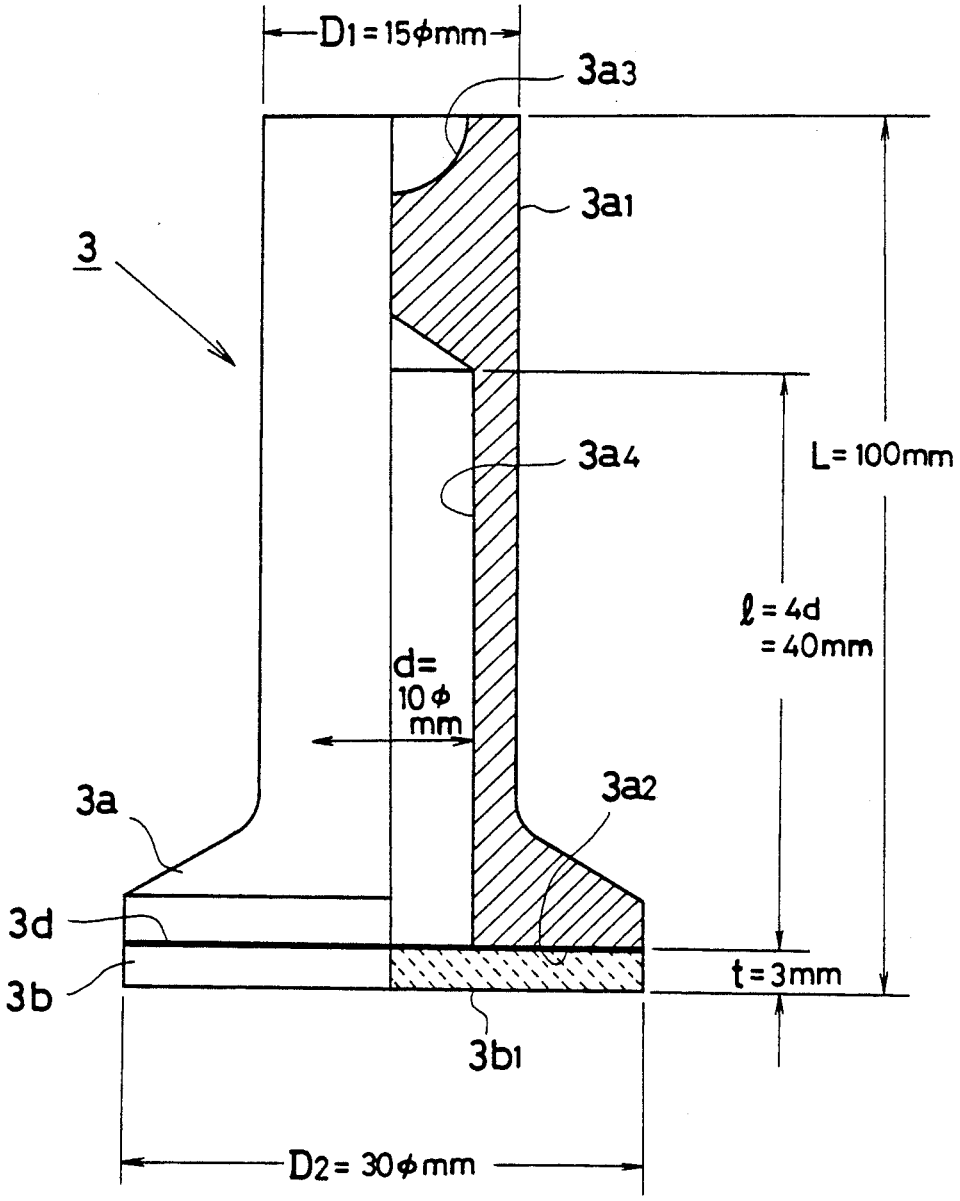
FIG. 1 is an enlarged longitudinal view of a tappet body according to a first embodiment of the invention.
Figure 2:
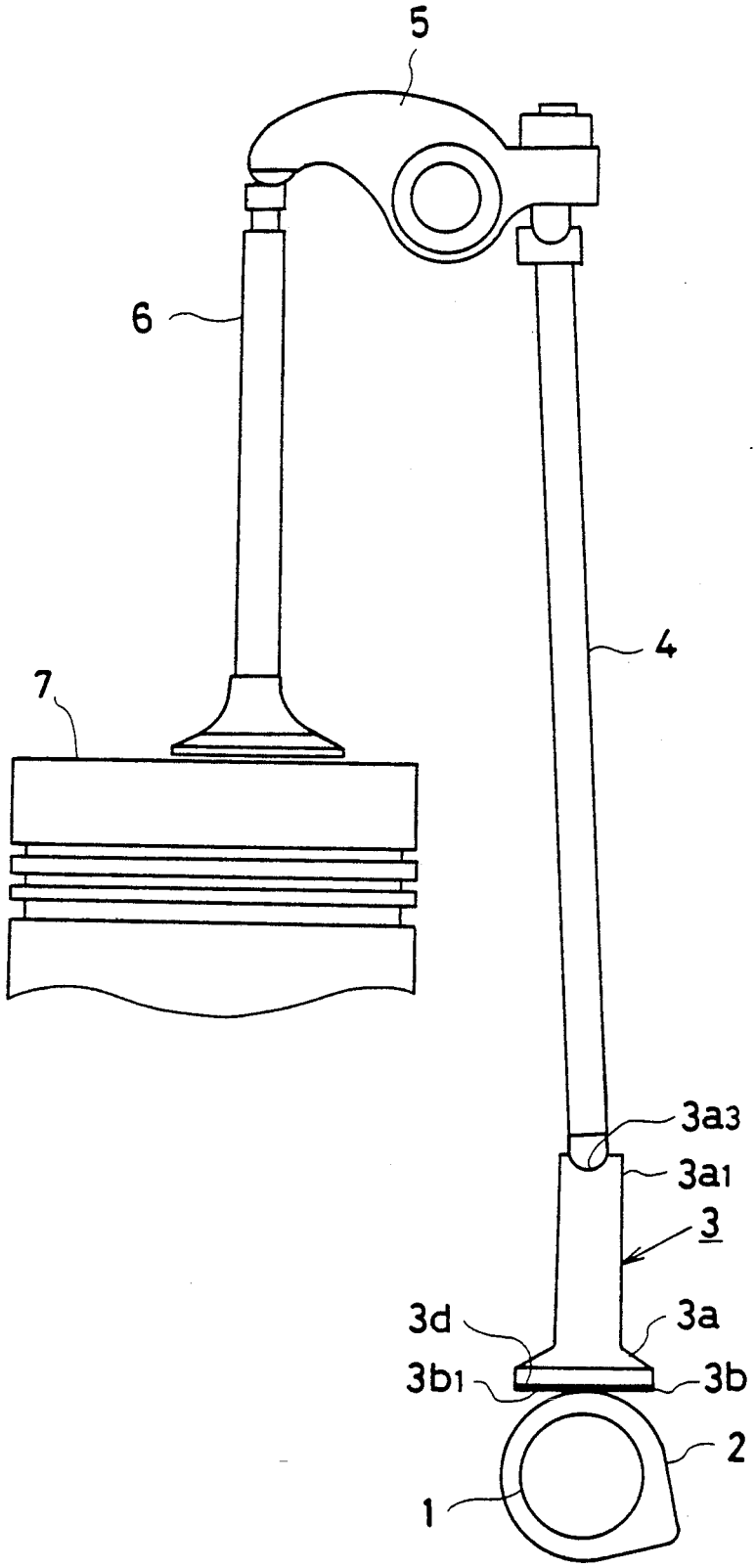
FIG. 2 is a schematic view of a dynamic valve system in OHV type of internal combustion engine into which a tappet body according to the present invention is incorporated.

In FIG. 1 in which a tappet 3 is shown, the tappet 3 is incorporated into a dynamic valve system as shown in FIG. 2. In FIG. 2, a push rod 4 is somewhat shortened and made thin for the purpose of reducing its weight. The tappet 3 according to the present invention comprises an alloyed tappet body 3*a*, and a friction-resistant ceramic plate 3*b* which is measured 30 mm in diameter (D2), and 3 mm in thickness (t) to have an entire axial length (L) of 100 mm. The tappet body 3*a* is made by cold forging Ni-Cr-Mo based steel alloy (JIS SNCM 630, Ni: 2.5~3.5%, Cr: 2.5~3.5%, Mo: 0.5~0.7%), and having a guide portion $3a_1$ at its upper portion which is 15 mm in diameter (D1).

At an upper end of the tappet body 3*a*, there is provided a semi-spherical recess $3a_3$ which receives an lower end of the push rod 4 by means of ball-and-socket joint. The tappet body 3*a* is hollowed by means of drilling to have an open lower end $3a_2$, an outer diameter of which is equivalent to the diameter (D2) of the ceramic plate 3*b*. A hollowed portion $3a_4$ of the tappet body 3*a* is measured 40 mm in depth ($l=4d$) and 10 mm in diameter (d).

The ceramic plate 3*b* is made from 90 wt % $Si_3N_4$ with some addition of auxiliary agent and binder which are integrally sintered under the normal pressure by means of a die press. Then, the ceramic plate 3*b* is finished by means of abrasive to have a cam sliding surface $3b_1$ at one side of the ceramic plate 3*b*.

In the meanwhile, a silver based braze sheet 3*d* is prepared from elements such as 27% Cu, 9.5% In, 1.25% Ti and 62.25% Ag, and blanked to form an annular sheet. Then, the ceramic plate 3*b* is concentrically put on the open lower end $3a_2$ of the tappet body 3*a* by way of the annular braze sheet 3*d*. In this instance, the braze sheet 3*d* is heated under vacuum atmosphere at 800 degrees Celsius for 15 minutes to integrally fix the ceramic plate 3*b* to the tappet body 3*a*.

In this example, Rockwell hardness of HRC 40 is obtained at the guide portion $3a_1$ which is sufficient enough to protect the guide portion $3a_1$ against friction. It is also found that the tappet 3 is up to 60% lighter in weight compared to a counterpart tappet made of solid hardenable cast iron of the same size.

In FIG. 2, a cam 2 is mounted on a camshaft 1, reciprocal movement of a piston 7 allows the cam 2 to frictionally slide on the surface $3b_1$ of the ceramic plate 3*b* to axially move the tappet 3 which causes to move a rocker arm 5 by way of the push rod 4, thus causes to operate a valve 6 so as to alternately open and close an intake and exhaust port each communicated with a combustion chamber (not shown).

An endurance experiment is carried out with the tappet 3 incorporated into an internal combustion engine. The engine is operated at 2500 rpm for 300 hours.

The result shows that no amount of wear is found on the cam sliding surface $3b_1$ of the ceramic plate 3*b*, while no destruction loss is recognized on the tappet 3 itself, although wear of 25 μm is found on a prior counterpart surface.

Figure 3:
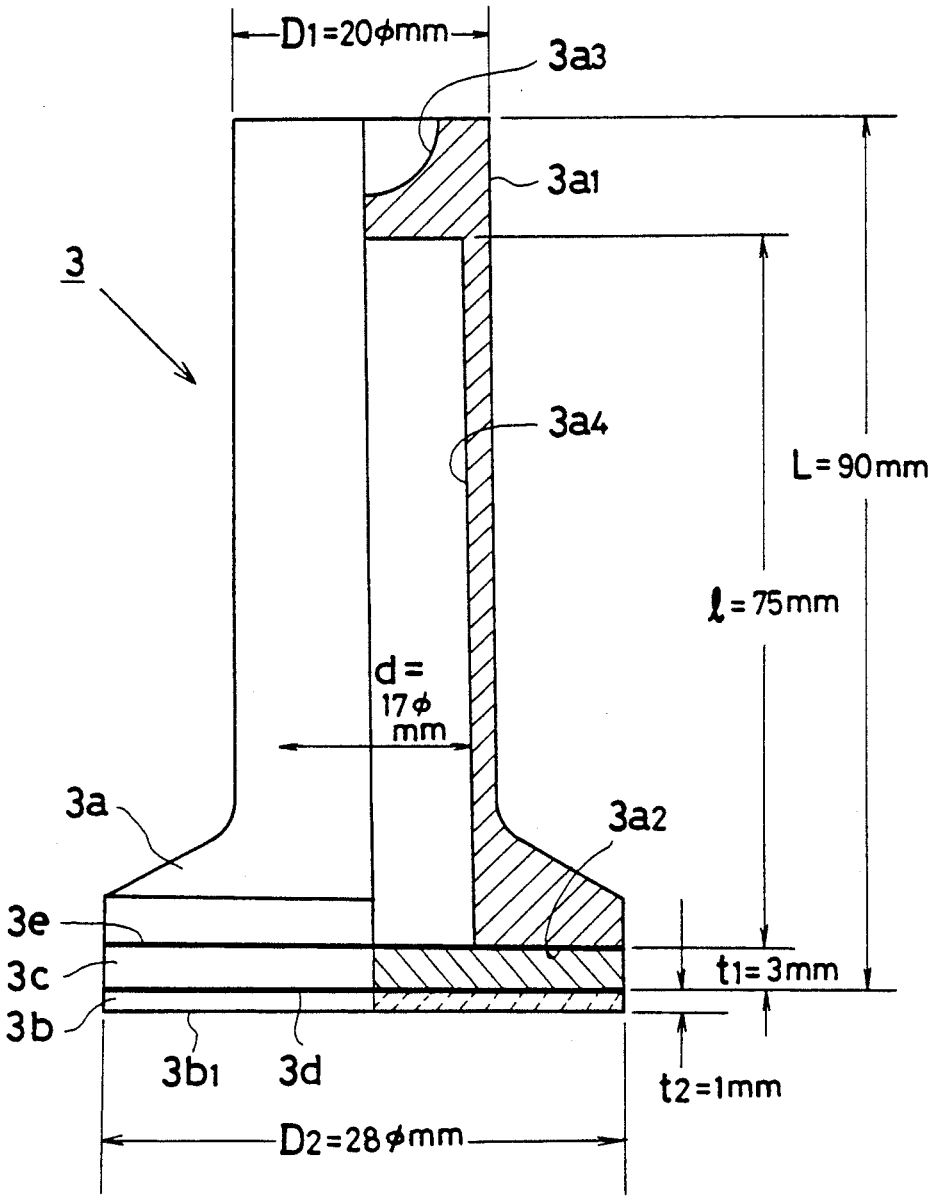
FIG. 3 is a view similar to FIG. 1 according to a second embodiment of the invention.

Referring to FIG. 3 in which a second embodiment of the invention is shown. In this embodiment, like reference numerals in FIG. 3 are identical to those in FIG. 1. The tappet body 3*a* is the same as in FIG. 1 except that the tappet body 3*a* is made from JIS SNCM 616 of different size. A metallic plate 3*c* is prepared from JIS SNCM 630 to have Young's modulus of more than $2\times10^4$ Kg/mm$^2$. Then, the metallic plate 3*c* is fixed to the open lower end $3a_2$ by means of In-Cu-Ag based braze 3*e* in the same manner as described in the first embodiment of the invention. On an outer surface of the metallic plate 3*c*, there is provided the ceramic plate 3*b* to concentrically overlap with the metallic plate 3*c*. Then, the ceramic plate 3*b* is integrally fixed to the metallic plate 3*c* by means of the silver based braze sheet 3*d* in the same manner as described in the first embodiment.

In this instance, the cam sliding surface $3b_1$ increases strike-resistant property against the cam 2, so that the hollow portion $3a_4$ can be increased for more lightweightness, while thickness of the ceramic plate 3*b* can be reduced for the purpose of cost-saving.

In this second embodiment of the invention, the hollow portion $3a_4$ is measured 17 mm in diameter (d), while the metallic plate 3*c* and the ceramic plate 3*b* are in turn measured 3 mm and 1 mm in thickness (t1) and (t2). At the hollow portion $3a_4$, a wall thickness of the tappet body 3*a* is reduced to 1.5 mm from 2.5 mm in the first embodiment.

It is also found that the tappet 3 is up to 80% lightweight compared to a counterpart tappet made of solid hardnable cast iron of the same size.

An endurance experiment is carried out with the tappet 3 incorporated into fourth and sixth cylinder of 8000 cc six-cylinder diesel engine, and with the prior counterpart incorporated into first and third cylinder. The engine is operated at 2500 rpm for 200 hours. In this experiment, lifting load of a valve spring is determined to be twice as great as that of normal one, and deteriorated oil is used to make the experiment severer.

The result shows that no chippings or cracks are found on the cam sliding surface $3b_1$ of the ceramic plate 3*b* as seen at table in FIG. 4.

It is appreciated that the hollow portion $3a_4$ may be made at the time when the tappet body 3*a* is cast by means of a core pattern instead of mechanical drilling. It is further noted that the metallic plate 3*c* may be interfit into the open lower end $3a_2$ of the tappet body 3*a* by means of press fit, shrinkage fit, roulette or serration. Various other modifications and changes may be also made without departing from the spirit and the scope of the following claims.

What is claimed is:

1. In a tappet structure in which a rotary movement is transformed into an axial movement by way of a cam, the tappet structure comprising:

a metallic tappet body, an inside of which is hollowed by means of drilling to have a lower open end and an upper closed end, said lower open end having a predetermined diameter;

a metallic plate having a diameter equivalent to said predetermined diameter integrally fixed to the lower open end of the tappet body in a manner to close the lower open end thereof by means of brazing, the metallic plate being made of JIS SNCM 630 and having a Young's modulus of more than $2\times10^4$ kg/mm$^2$, the metallic plate being joined to the lower open end of the tappet body by concentrically locating an annular braze sheet between the lower open end of the tappet body and the metallic plate, and heating the annular braze sheet to approximately 800 degrees Celsius in a vacuum atmosphere; and a friction-resistant ceramic plate having a diameter equivalent to said predetermined diameter integrally fixed to the lower open end of the tappet body through the metallic plate by means of brazing, so that the cam can frictionally slide on the ceramic plate to axially move the tappet body, the ceramic plate being joined to the tappet body through the metallic plate by concentrically locating a braze sheet between the metallic plate body and the ceramic plate, and heating the braze sheet so as to fix the ceramic plate to the metallic plate in overlapping relationship with each other, so that the ceramic plate is reinforced by the metallic plate.

2. In a tappet structure as recited in claim 1, the ceramic plate being made of silicon nitride as a main component, the tappet body being made by cold forging Ni-Cr-Mo based steel alloy, the upper closed end portion of the tappet body serving as a guide portion, the guide portion having a Rockwell Hardness factor of 40, a semi-circular recess being formed on the upper closed end of the tappet body for receiving a lower end of a push rod in a manner of a ball-and-socket joint.

* * * * *